US009123314B2

(12) United States Patent
Creek

(10) Patent No.: US 9,123,314 B2
(45) Date of Patent: Sep. 1, 2015

(54) ADJUSTABLE SHOULDER STRAP HOLDER FOR MUSICAL INSTRUMENT

(71) Applicant: Kathryn L. Creek, Los Alamos, NM (US)

(72) Inventor: Kathryn L. Creek, Los Alamos, NM (US)

( * ) Notice: Subject to any disclaimer, the term of this patent is extended or adjusted under 35 U.S.C. 154(b) by 0 days.

(21) Appl. No.: 14/163,091

(22) Filed: Jan. 24, 2014

(65) Prior Publication Data

US 2014/0208920 A1 Jul. 31, 2014

Related U.S. Application Data

(60) Provisional application No. 61/800,956, filed on Mar. 15, 2013, provisional application No. 61/757,278, filed on Jan. 28, 2013.

(51) Int. Cl.
*G10G 5/00* (2006.01)
*G10D 1/08* (2006.01)

(52) U.S. Cl.
CPC ..... *G10G 5/005* (2013.01); *G10D 1/08* (2013.01); *G10G 5/00* (2013.01)

(58) Field of Classification Search
CPC ..... G10G 5/005; G10G 5/00
See application file for complete search history.

(56) References Cited

U.S. PATENT DOCUMENTS

| | | | | |
|---|---|---|---|---|
| 1,699,921 | A * | 1/1929 | Rindsberg | 29/888.05 |
| 2,773,564 | A * | 12/1956 | Garard | 188/32 |
| 2,948,173 | A * | 8/1960 | Herrmann | 81/474 |
| 3,088,416 | A * | 5/1963 | Danis | 415/132 |
| 4,037,505 | A * | 7/1977 | Maples | 84/280 |
| 4,192,213 | A * | 3/1980 | Steinberger | 84/293 |
| 4,247,029 | A * | 1/1981 | Levin | 224/271 |
| RE31,722 | E | 11/1984 | Steinberger | |
| 4,592,266 | A * | 6/1986 | Daugherty | 84/327 |
| 4,632,002 | A * | 12/1986 | Clevinger | 84/731 |
| 5,817,959 | A * | 10/1998 | Kagan | 84/280 |
| 5,936,173 | A | 8/1999 | Tonon | |
| 6,084,165 | A | 7/2000 | Chapman | |
| 6,791,018 | B2 | 9/2004 | Bazata | |
| 6,998,523 | B1 * | 2/2006 | DeVuono | 84/280 |
| 7,342,160 | B2 * | 3/2008 | Alberti | 84/280 |
| 7,375,269 | B2 * | 5/2008 | Perkins | 84/327 |
| 7,744,634 | B2 * | 6/2010 | Farris | 606/260 |
| 2010/0089218 | A1 * | 4/2010 | Erismann | 84/327 |
| 2013/0139668 | A1 * | 6/2013 | Aires | 84/267 |
| 2014/0208920 | A1 * | 7/2014 | Creek | 84/327 |

OTHER PUBLICATIONS

Alembic Club, Stanley "Small" Body with 34 Scale? . . . , Alembic Forum Posting, http://alembic.com/club/messages/402/51912.html?1211288408, p. 2, May 2008.

(Continued)

*Primary Examiner* — Robert W Horn
(74) *Attorney, Agent, or Firm* — Thomas E. Lees, LLC

(57) ABSTRACT

An adjustable strap holder comprises a housing having an end face and a channel that extends from the end face axially into the housing. The adjustable strap holder also comprises an extension rod or bar that extends into the channel of the housing so as to have an exposed end that extends from the end face and a strap button secured to the exposed end of the extension rod. Further, the adjustable strap holder comprises a release mechanism coupled to the channel, where the release mechanism is operated by a user so as to allow the extension rod to be adjusted axially relative to the end face and/or removed from the instrument body.

20 Claims, 14 Drawing Sheets

(56) References Cited

OTHER PUBLICATIONS

TDPRI, Telecaster Discussion Page Reissue, Telecaster Guitar Forum, see p. 6, #16, http://www.tdpri.com/forum/bass-place/140635-tele-bass-questions.html, Jan. 21, 2009.

Bassesbyleo.com, The Official G&L Bass Support Forum, pp. 4, 7 and 8, Aug. 12, 2010.

Boomerang Strap System Instructions, http://thinkns.com/pdfs/boomerang.pdf, downloaded Oct. 18, 2012.

Steinberger Synapse Bass Strap Hook with Screws, Musician's Friend Inc., downloaded Oct. 18, 2012.

* cited by examiner

ADJUSTABLE SHOULDER STRAP HOLDER FOR MUSICAL INSTRUMENT

CROSS REFERENCE TO RELATED APPLICATIONS

This application claims the benefit of U.S. Provisional Patent Application Ser. No. 61/800,956, filed Mar. 15, 2013, entitled ADJUSTABLE SHOULDER STRAP HOLDER FOR MUSICAL INSTRUMENT, and U.S. Provisional Patent Application Ser. No. 61/757,278, filed Jan. 28, 2013, entitled ADJUSTABLE SHOULDER STRAP HOLDER FOR MUSICAL INSTRUMENT, the disclosures of which are hereby incorporated by reference.

BACKGROUND

The present invention relates in general to musical instruments, and in particular to an extendable strap mechanism for attaching a shoulder strap to the musical instrument.

A shoulder strap is typically used by a musician to support a musical instrument (e.g., a guitar or bass guitar) in a comfortable playing position while the musician is standing. More particularly, the musical instrument typically includes two strap buttons that are fixedly secured to the instrument body. A first strap button (also referred to as a strap pin) is fixedly attached (e.g., using a screw) to the edge of the body along a lower bout thereof. A second strap button is fixedly attached (e.g., also using a screw) to a tip of a top horn positioned on an upper bout of the instrument body. A musician attaches a shoulder strap, which is typically a long, slender flexible material made of leather, nylon, etc., between the two strap buttons. This allows the musician to sling the shoulder strap across the musician's shoulder to hold the instrument in a desired playing position.

BRIEF SUMMARY

According to aspects of the present invention, an adjustable strap holder for a stringed musical instrument is provided. The adjustable strap holder comprises a housing, an extension rod, and a release mechanism. The housing has an end face and a channel that extends from the end face axially into the housing. The extension rod is received into the channel through the end face of the housing. The release mechanism cooperates with the extension rod to allow the extension rod to be adjusted axially relative to the housing. Additionally, a strap button may be secured to the exposed end of the extension rod.

According to further aspects of the present invention, a musical instrument having a body and neck that extends from the body, comprises a channel that extends from an end face of the body proximate to an intersection of the neck and body, where the channel extends axially into the body. In illustrative implementations, the channel extends into the body parallel to the length of the neck. The instrument also comprises an extension rod that extends into the channel so as to have an exposed end that extends from the end face of the body. The instrument also includes a release mechanism that cooperates with the extension rod. The release mechanism is operated by a user so as to allow the extension rod to be adjusted axially relative to the end face of the body. In illustrative implementations, the extension rod is user-adjustable so as to extend and retract axially parallel to, and spaced from the back of the neck. A strap button may be secured to the exposed end of the extension rod.

According to yet further aspects of the present invention, a musical instrument is provided. The musical instrument comprises a body having an upper bout, a neck coupled to the body at a position along the upper bout, an extension rod that is user-adjustable to extend and retract out from the body spaced from and behind the neck. A strap button may be secured to an end of the extension rod. Also, the extension rod may be detachable from the body and/or adjustable in an axial direction along the length of the neck.

DETAILED DESCRIPTION

According to various aspects of the present disclosure, a strap holder is provided, which is suitable for use with a musical instrument. The strap holder disclosed herein is particularly well suited for use on a stringed musical instrument, such as a guitar or bass guitar. As will be described in greater detail herein, the strap holder comprises an extension rod that is coupled to the body of the instrument such that a strap button positioned at the end of the extension rod extends away from, and is spaced from the instrument body. Moreover, the extension rod is aligned with, and is positioned behind the neck when viewed from the face of the instrument. The extension rod can provide the positioning of the strap button at a fixed position behind the neck relative to the instrument body. Alternatively, the extension rod may be manually adjustable. As such, a user can extend or retract the strap button lengthwise along the direction of the neck so as to move the strap button relatively closer to, or further from the instrument body. In this configuration, the musician can adjust the strap button to a desired position, e.g., to achieve a comfortable performance position, to balance the instrument on the musician, etc. In the various embodiments herein, a strap button located at the tip of the upper/top horn of the instrument body is unnecessary. Moreover, using the strap holder herein, strap positions are achievable which could otherwise not be possible on a conventional instrument.

Figure 1:
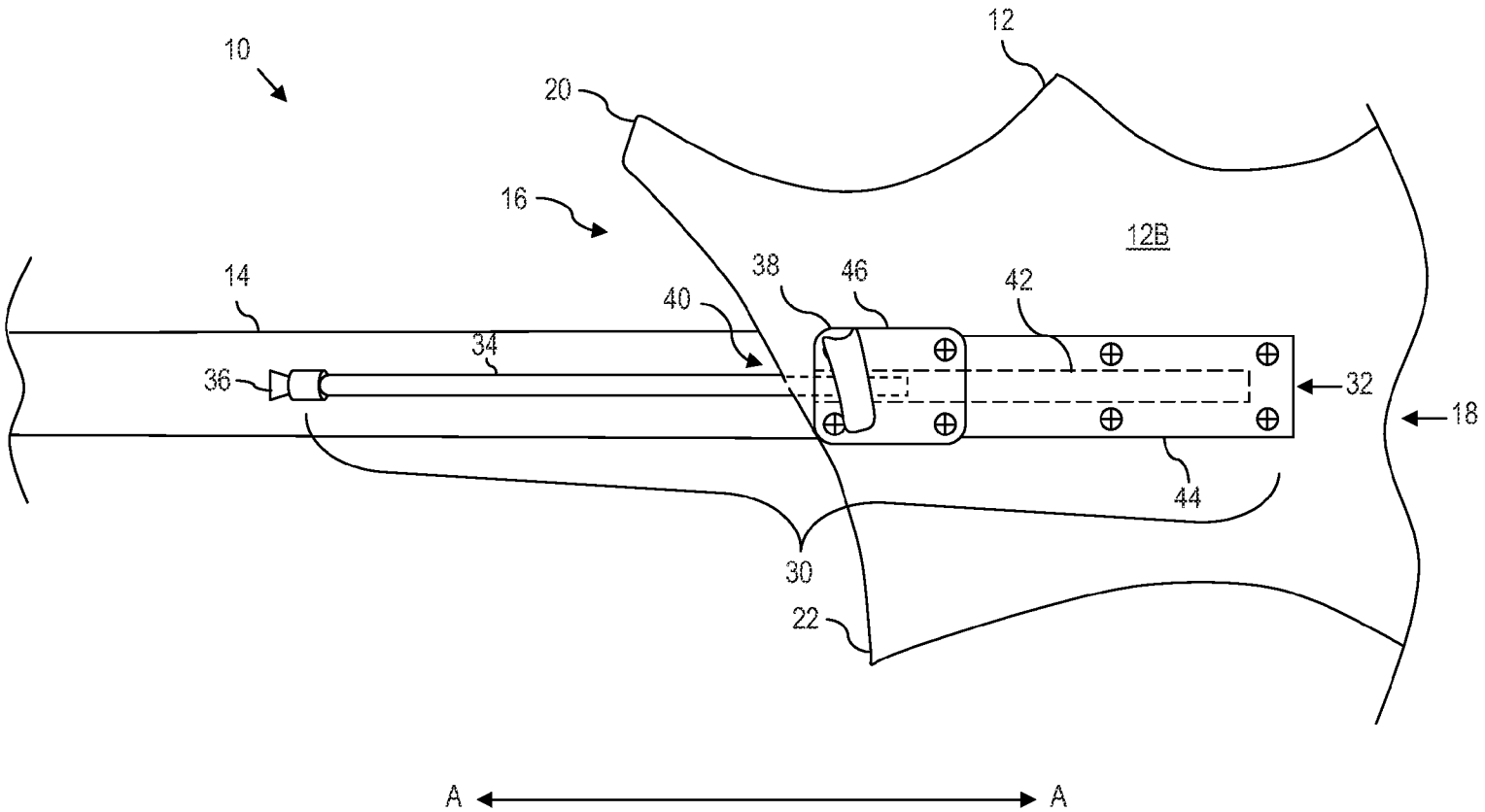
FIG. 1 is a view of a portion of a musical instrument from the back, illustrating an extension rod in an extended position, according to aspects of the present disclosure.

Adjustable Strap Holder Integrated into Musical Instrument:

Referring now to the drawings, and in particular, to FIG. 1, a view of a portion of a musical instrument 10 is illustrated looking towards the back of the musical instrument 10. The musical instrument 10 may be a guitar, bass guitar or other stringed instrument where it is desirable to attach a strap such as a conventional shoulder strap, to the instrument 10. The illustrated musical instrument 10 includes in general, a body 12 and a neck 14 extending from the body 12. The body 12 includes a front face 12A (not shown in FIG. 1—See FIG. 5) and a back face 12B.

The body 12 is conceptually divided into two general regions, including an upper bout 16 and a lower bout 18. The upper bout 16 is typically separated from the lower bout 18 by a waist or narrowed/tapered region of the body. The upper bout 16 is the portion of the body 12 in the vicinity of where the neck 14 extends from the body 12, e.g., from the waist towards the neck 14. The neck 14 divides the upper bout 16 into two sub-regions, including a top region 20, illustrated by a top horn and a bottom region 22 illustrated by a bottom horn. However, in practice, the upper bout 16 can take any desired shape. The lower bout 18 is the region from the waist towards the bottom of the instrument 10, and is thus positioned back towards the bridge (not visible from the back view of FIG. 1) of the instrument 10. The lower bout 18 is typically rounded, but can take any desired shape.

A typical musical instrument includes a strap button that is fixedly secured to the top region (top horn) of the upper bout 16. However, this approach requires that the top region 20 extends out towards the headstock far enough to properly balance the musical instrument 10 when strapped to a musician. Otherwise, the instrument will be unbalanced. Because of the length of the neck 14 (particularly in the case of a bass guitar), the instrument 10 may be neck-heavy when strapped to a musician, causing the neck 14 to want to rotate downward. This causes the musician to be forced to support the neck 14 with the fretboard hand, which can lead to performer fatigue, discomfort and difficulty playing the instrument 10. Moreover, the fixed position of the strap button eliminates any adjustability in how the shoulder strap attaches to the instrument. As such, the musician cannot make adjustments to the positioning of the shoulder strap relative to the instrument 10, e.g., for balance, performance posture, playing position, etc.

However, according to aspects of the present disclosure, a strap holder 30 is provided. The strap holder 30 comprises in general, a housing 32, an extension rod 34, a strap button 36 and a release mechanism 38. The housing 32 has an end face 40 and a channel 42 that extends from the end face 40 axially into (or otherwise along—See FIG. 6) the housing 32. Here, the term "axially" is in the lengthwise direction of the neck, i.e., in the direction A-A as illustrated. Also, the channel 42 is illustrated in dashed lines to indicate that the channel is within the body 12.

As will be described in greater detail herein, the housing 32 may be a separate member, e.g., a tube, insert or other structure that is installed on or otherwise within the body 12 of the musical instrument 10. Alternatively, the housing 32 may be defined by the body 12 itself, e.g., by drilling a hole into the body 12 through the end face 40 to define the channel 42. In yet another implementation, the housing 32 may be the body 12 of the instrument 10, where the channel 42 is routed into the body from a back face 12B. Where the channel 42 is routed into the body 12 through the back face 12B, an optional plate 44 can be used to cover the routed section.

Also, where the musical instrument 10 includes a bolted on neck 14, the musical instrument 10 may include a neck plate 46 at the neck pocket where the neck 14 bolts to the body 12.

For neck-through and other constructions that do not have a heel, the extension rod 34 can integrate with or otherwise attach to the instrument body 12 in the vicinity of the union/transition of body 12 and neck 14.

Still further, the housing 32 can attach to or otherwise secure the extension rod 34 to the instrument body 12, e.g., to add the strap holder 30 to an existing musical instrument.

Although illustrated as a generally round bar for purposes of clarity of explanation, in practice, the extension rod 34 can be a rod, bar or have any other cross-section and shape. Correspondingly, the channel 42 can have a round, rectangular or other cross-section and shape.

In the illustrative implementation, the channel 42 extends into the body 12 parallel the neck 14 and the end face 40 is located at the neck joint where the neck 14 joins the body 12. The extension rod 34 is positioned in the channel 42 of the housing 32 so as to have an exposed end that extends out from the end face 40, e.g., extends out from the body 12 of the musical instrument 10 at the union of the neck 14 and body 12, e.g., at the neck pocket, heal or other neck/body transition. The strap button 36 is secured to the exposed end of the extension rod 34. The extension rod 34 may also optionally include other features, such as a stop at the end of the extension rod 34 opposite the strap button 36, which may be used to prevent the extension rod 34 from extending out of the channel 40 (where such an embodiment is desired).

The release mechanism 38 is provided to secure the extension rod 34 in a desired position (where adjustable) or to otherwise install the extension rod 34 onto the instrument 10 (such as where the extension rod 34 can be removed entirely from its housing 32). In this regard, the release mechanism 38 may be implemented using any number of devices, such as a clamp having a user operable lever on the outside of the housing (e.g., external to the back surface 12B of the body 12), a clamp having a screw, pin, a friction causing surface, or other suitable device. Thus, the release mechanism 38 is any structure that allows the extension rod 34 to be secured from moving axially relative to the instrument 10. The release mechanism 38 may further allow user-adjustability of the extension rod 34 relative to the housing 32. Thus, the release mechanism 38 may be coupled to the channel 40, the release mechanism 38 may cooperate with the extension rod 34, or the release mechanism may be otherwise implemented to perform the functions described herein.

In the illustrative implementation, the release mechanism 38 is illustrated as a clamp that is user-adjustable between a first position where the extension rod 34 is capable of sliding within the channel 42, and a second position where the extension rod 34 is locked from axial movement relative to the channel 42. In this manner, the illustrated release mechanism 38 is selectively operated by a user so as to allow the extension rod 34 to be adjusted axially relative to the end face 40. For instance, as illustrated in FIG. 1, the extension rod 34 is extended axially out from the end face 40, thus positioning the strap button 36 relatively closer to the headstock (not shown) of the neck 14.

Figure 2:
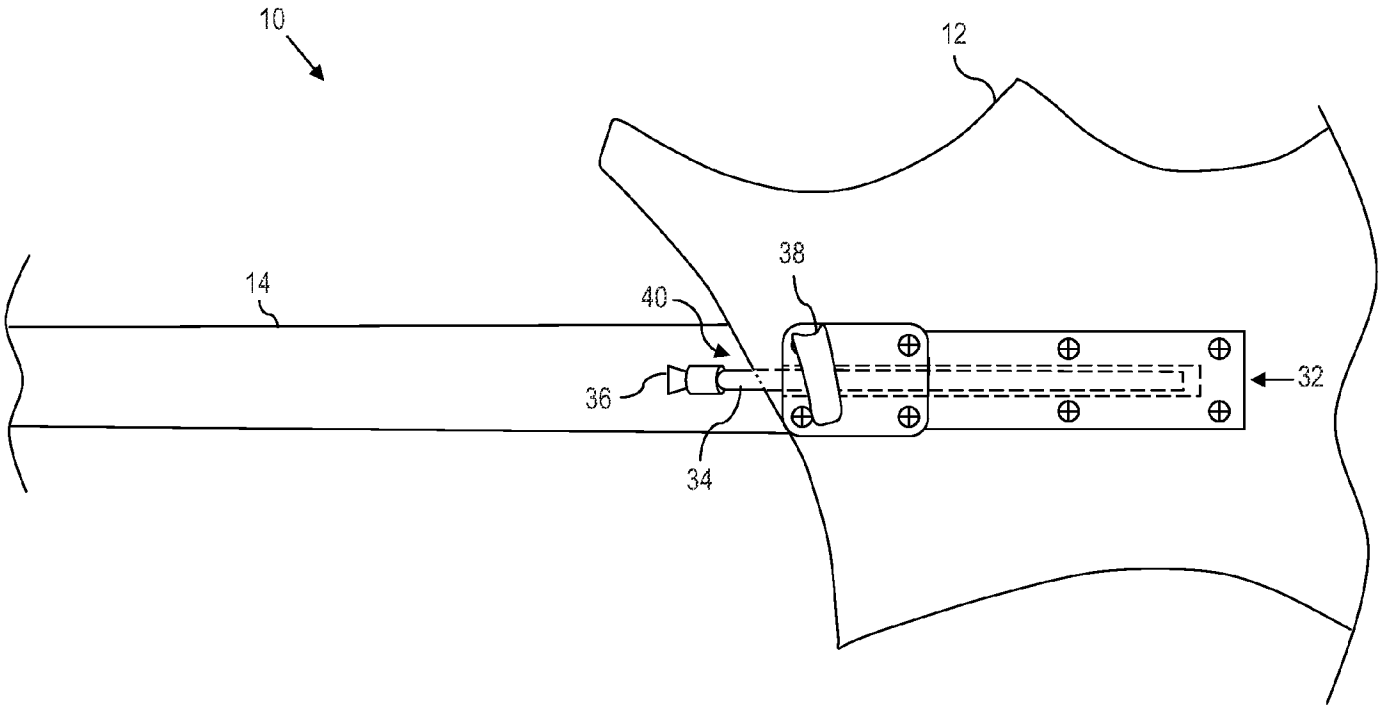
FIG. 2 is a view of a portion of the musical instrument of FIG. 1, illustrating the extension rod in a retracted position, according to aspects of the present disclosure.

Referring to FIG. 2, the release mechanism 38 has been operated and the extension rod 34 has been axially adjusted so as to retract into the body 12 (via the housing 32) of the musical instrument 10, thus positioning the strap button 36 relatively closer to the end face 40 (compared to the positioning of the strap button 36 illustrated in FIG. 1). In this regard, the strap button 36 can be positioned anywhere within a range determined by the length of the extension rod 34. However, in certain illustrative implementations, regardless of adjusted position, the extension rod 34 remains behind the neck 14.

In an alternative embodiment, the extension rod 34 may be configured to have a fixed length when attached to the instrument (i.e., not axially adjustable), yet be detachable from the instrument 10. In this implementation, the release mechanism 38 may be used to selectively attach and detach the extension rod 34 from the instrument 10.

Referring to the Figures generally, the release mechanism 38 can be a clamping lever. In this implementation, a user can transition the lever between locked and unlocked positions. In the locked position, the release mechanism resists axial movement of the extension rod 34, thus effectively locking the extension rod 34 into a desired position. Alternatively, transitioning the lever to the unlocked position allows the user to freely slide the extension rod 34 in and out of the housing 32 or otherwise detach the extension rod (in corresponding embodiments) from the instrument 10. Thus, in the unlocked state, the extension rod is capable of sliding within the channel 42 or is otherwise detachable from the instrument body 12. The release mechanism 38 need not include a lever. Rather, the release mechanism 38 may include a screw, pin, friction causing surface or other user operable feature to cause a clamp to selectively lock and unlock the extension rod 34.

For instance, in yet another alternative implementation, the release mechanism 38 comprises a friction mechanism that resists axial movement of the extension rod 34. In this implementation, the release mechanism 38 need not include a lever or other user control extending from the body 12. For instance, the release mechanism 38 may comprise a grommet, bearing or other device through which the extension rod 34 passes, which applies friction to the shaft of the extension rod 34. In this illustrative implementation, the resistance of the release mechanism 38 on the extension rod 34 is overcome by a user pushing the extension rod 34 inward to shorten the amount that the extension rod 34 extends from the end face 40, and by pulling the extension rod 34 to increase the amount that the extension rod 34 extends from the end face 40.

Figure 3:
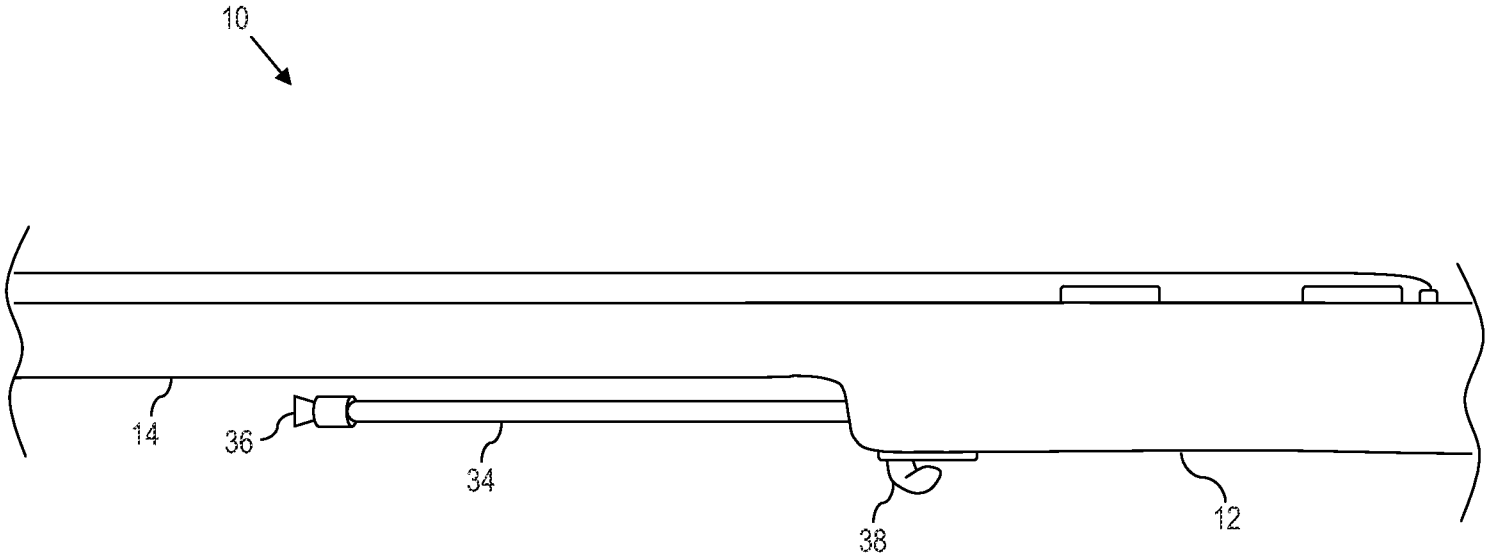
FIG. 3 is a view of a portion of the musical instrument of FIG. 1 taken from the top side of the instrument, according to aspects of the present disclosure.

Referring to FIG. 3, a view of the adjustable strap holder 30 is illustrated, looking down a side edge of the body 12 of the musical instrument 10. In the illustrative implementation, the extension rod 34 extends generally parallel to and spaced from the neck 14, and is generally centered along the width of the neck 14. In alternative implementations, the extension rod 34 extends slightly above the neck 14. However, the extension rod 34 and corresponding strap button 36 are spaced sufficiently far enough back from the back surface of the neck 14 or above the neck centerline to allow the musician's hand to slide freely between the neck 14 and the extension rod 34 and strap button 36. As such, the strap holder does not interfere with normal performance of the musical instrument. In the embodiment of FIG. 3, the release mechanism 38 includes a lever. However, such need not be the case as described more fully herein.

Figure 4:
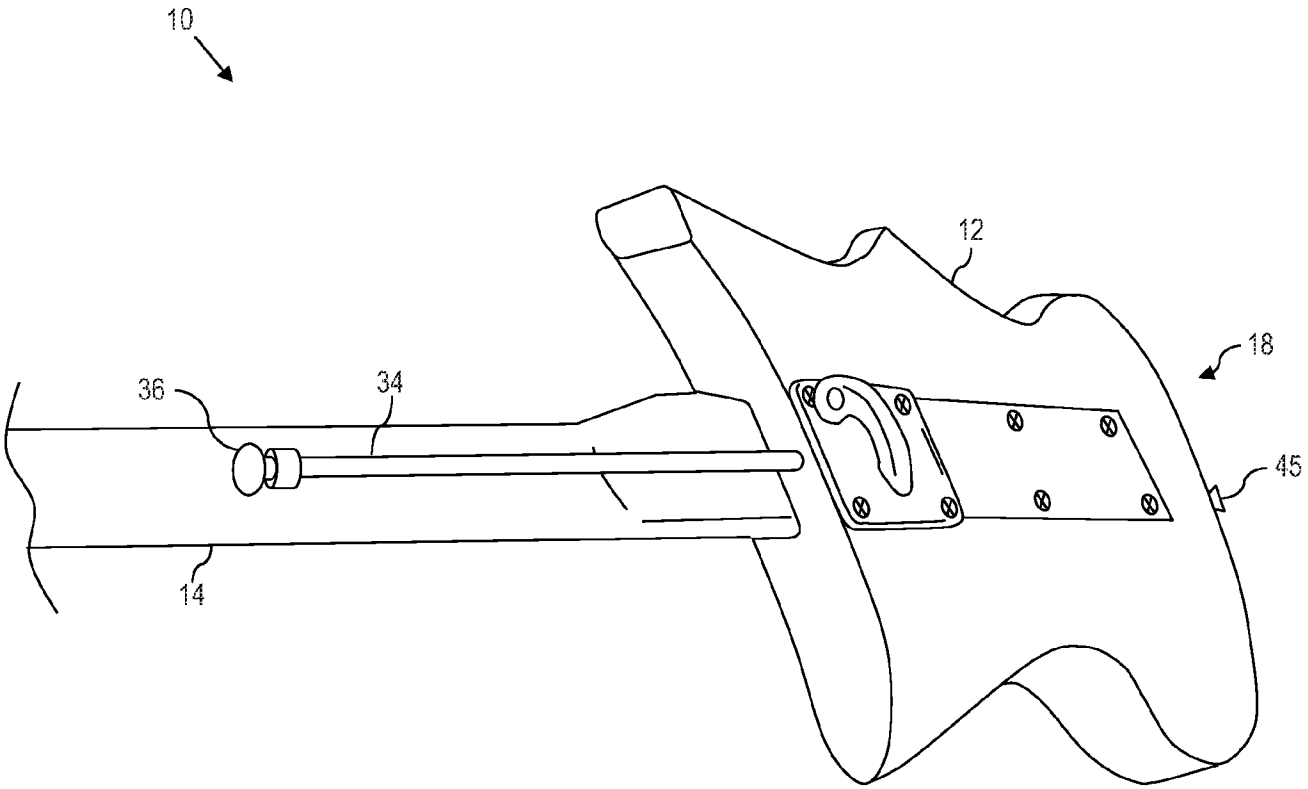
FIG. 4 is a perspective view of a portion of the musical instrument of FIG. 1, according to aspects of the present disclosure.

Referring to FIG. 4, a perspective view illustrates the back of the musical instrument 10 with the extension rod 34 extended. As FIG. 4 further clarifies, because the extension rod 34 is spaced from the back of the neck 14, there is adequate clearance for a musician to slide a hand up the neck 14 while performing on the musical instrument 10. That is, the extension rod 34 and strap button 36 do not create an interference with normal performance gestures. FIG. 4 illustrates a strap button 45 secured to the body 12 generally centered along the lower bout 18.

Figure 5:
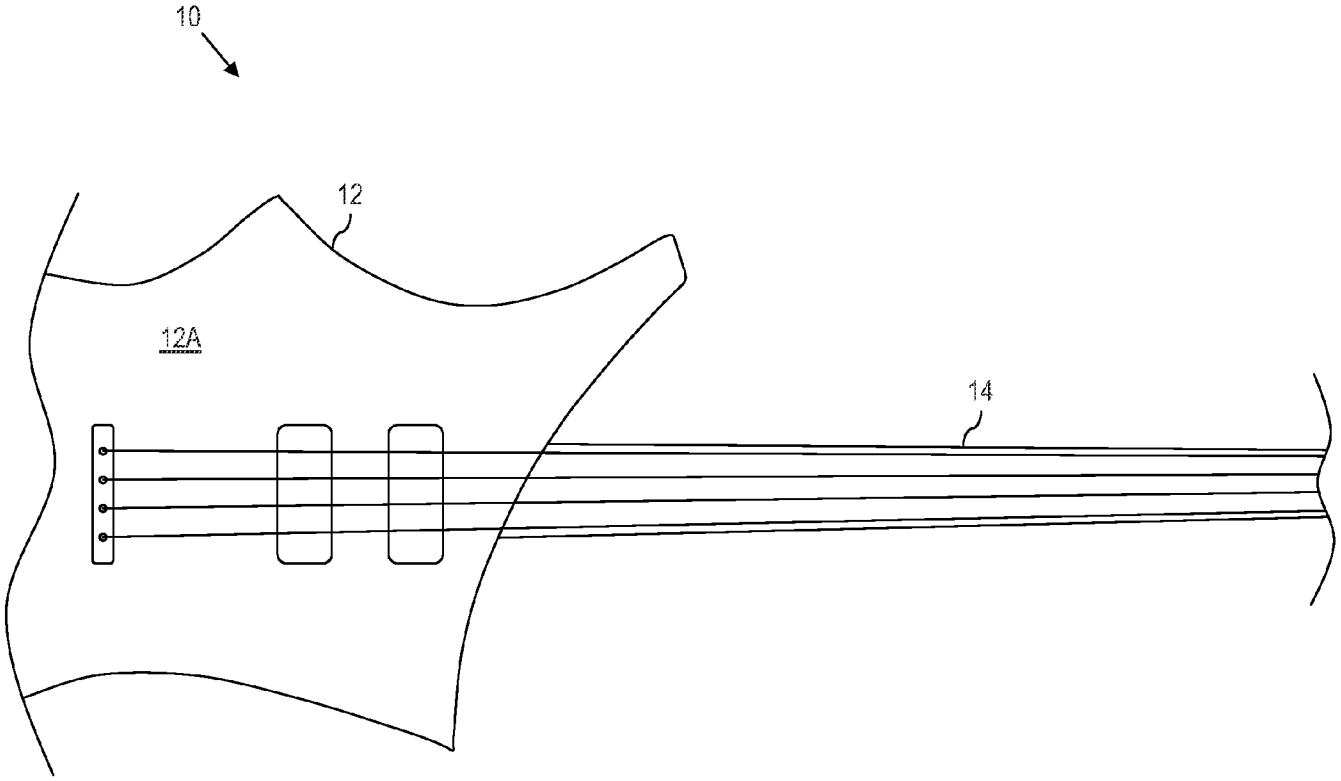
FIG. 5 is a view of the front of the musical instrument of FIG. 1, according to aspects of the present disclosure.

Referring to FIG. 5, the front face 12A of the body 12 is illustrated. Also, FIG. 5 illustrates an embodiment where the extension rod 34 is situated behind the neck 14. As such, the extension rod 34 is not visible from a direct-on front view of the musical instrument 10. As such, when viewed from the front, straight on, the adjustable strap holder creates the visual appearance that the strap attaches to the neck. In other embodiments, it may be possible to see a section of the extension rod 34 from a front view of a corresponding instrument, such as where it is necessary to achieve proper balance.

A conventional stringed instrument typically has a shoulder strap button that connects to the body of the instrument at the tip of the upper horn (top upper bout of the body). If the strap button is not properly positioned, e.g., sits too far down the neck (away from the headstock), the neck becomes out of balance with the body, thus making the instrument difficult to hold and play. For instance, certain stringed instruments, such as small-bodied basses, may not have an upper horn that extends out enough to provide a proper balance point for a strap to balance the instrument when a musician is performing in a standing position.

However, according to aspects of the present invention, a strap holder is provided that allows ready adjustment of the position of the strap button, as illustrated in the FIGURES and as described herein. This allows the musician not only to set the strap button position for proper overall balance of the instrument, but also to be able to make adjustments from time to time. Moreover, the extension rod can be completely removed from the instrument or otherwise retract into the instrument body for storage of the instrument in a conventional case.

Because of the neck contour and the thickness of the instrument body, there is sufficient spacing between the strap button, extension rod and the back of the neck for the musician's hand to slide up and down between the neck and extension rod without interference by the strap button or extension rod. Thus, the adjustable strap holder does not interfere with the musician's access to upper frets/upper registers of the instrument.

As noted in greater detail herein, in certain illustrative implementations, the extension is coupled to the body of the musical instrument within the channel so that a portion of the strap button's extension rod extends out from the body at the union/transition of the neck and body. Accordingly, the strap button extends out (on the end of the extension rod) generally aligned with, and behind the neck of the instrument, thus concealing the visual appearance of the strap button 36 when viewed looking straight on towards the front face of the musical instrument.

In operation of an exemplary implementation, the musician unlocks the locking mechanism or otherwise operates a release, freeing the strap button and corresponding extension rod to reciprocate within the channel. This allows the strap button to extend and retract along the length of the neck to a desired position. The musician then manually slides the strap button at the end of the strap button's extension rod to a position that places the instrument in a natural and balanced position. Once the desired position is located, the musician can operate the locking mechanism to lock the strap button rod into place.

Adjustable Strap Holder Attachable to a Musical Instrument:

The adjustable strap holder 30 can also be constructed so as to be attachable to an existing instrument 10 to provide strap pin adjustability as described more fully herein.

Figure 6:
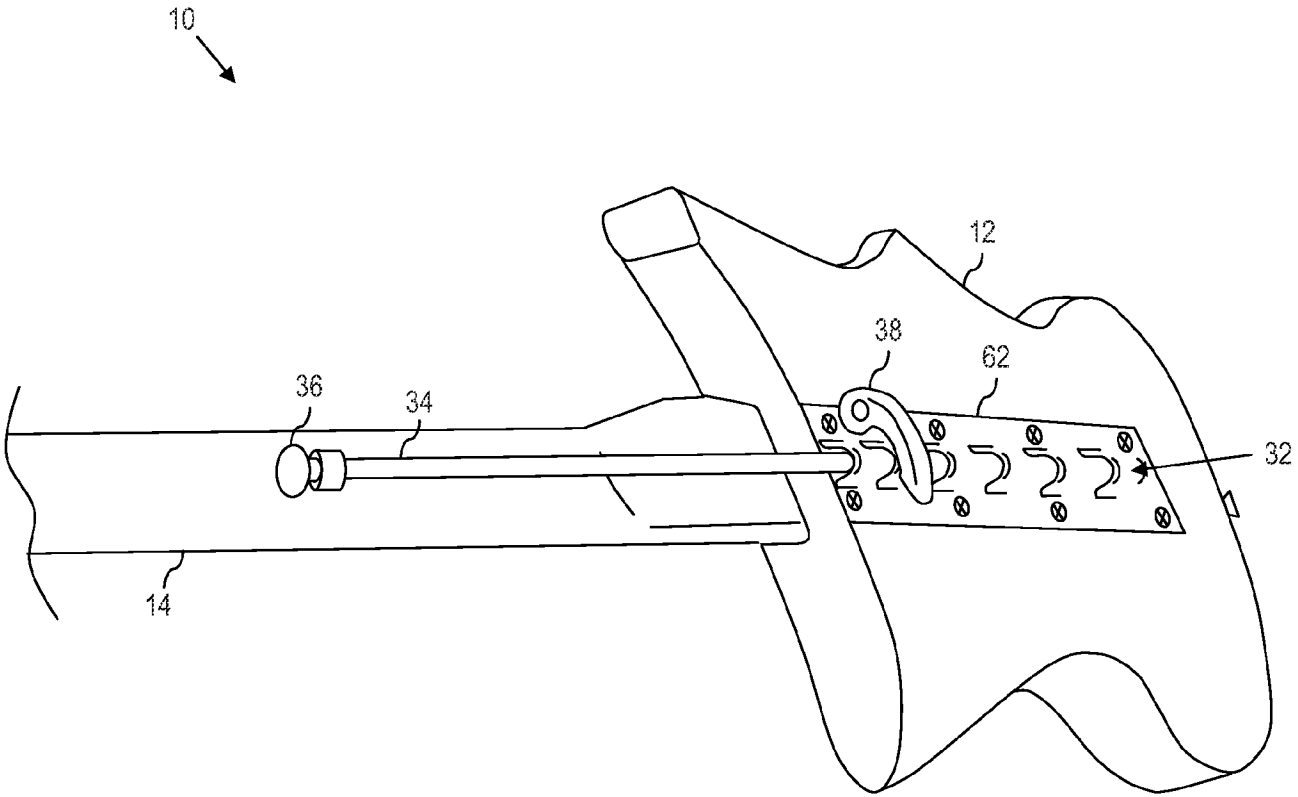
FIG. 6 is a view of a portion of a musical instrument from the back, illustrating an extension rod according to further aspects of the present invention.

For instance, referring to FIG. 6, the extension rod 34 need not be provided within the body 12 of the instrument 10 itself. As illustrated, the housing 32 may be implemented as a plate 62 that defines a channel 64 for receiving the extension rod 34. For instance, the channel 64 may be fully defined within the plate 62, or the channel 64 may be defined between the plate 62 and the instrument body 12. In this illustrative implementation, plate 62 may be configured to allow the extension rod 34 (and hence, the strap button 36) to be axially adjustable, thus providing the user the ability to set the length of the extension rod 34 from the body 12. Alternatively, the plate 62 may be configured to fixedly attach the extension rod 34 to the body 12. Otherwise, this strap holder may incorporate any combination of features from any of other embodiments described herein. For instance, although the release mechanism 38 is illustrated as having a lever, in practice the release mechanism 38 can be implemented using other techniques, examples of which are set out herein.

Figure 7A:
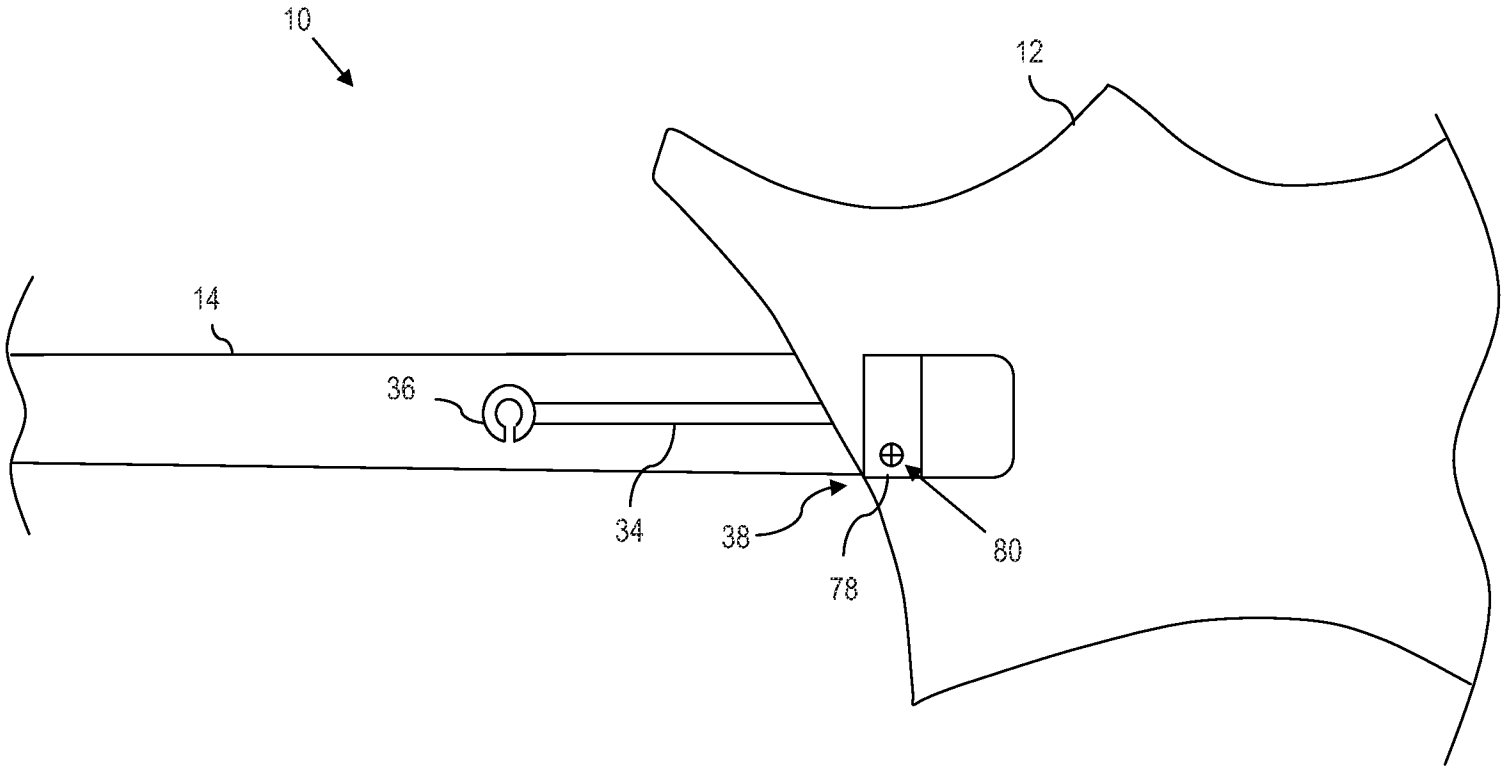
FIG. 7A is a view of a portion of a musical instrument from the back, illustrating an extension rod according to yet further aspects of the present invention, according to aspects of the present disclosure herein.
Figure 7B:
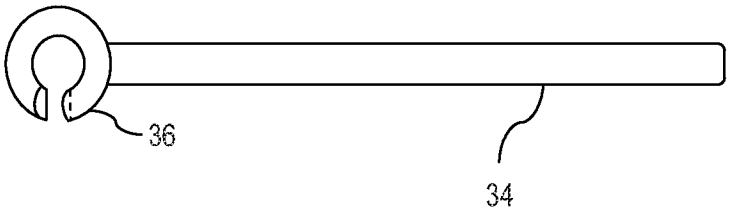
FIG. 7B is a view of the extension rod of FIG. 7A, according to aspects of the present disclosure herein.

Referring to FIG. 7A, in yet a further alternative implementation, the strap button 36 is implemented as an eyelet at the end of the extension rod 34. As illustrated with reference to FIGS. 7A and 7B, the eyelet is rotated so that the opening is oriented perpendicular to the length of the extension rod 34 and parallel to the face of the instrument body. Thus, the strap button is further oriented orthogonal to the length of the neck 14.

Figure 7C:
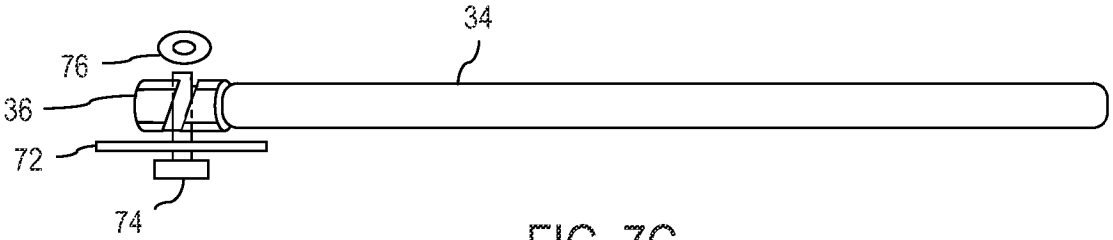
FIG. 7C is a close up of the end of the extension rod of FIG. 7A, showing an exemplary shoulder strap attachment, according to aspects of the present disclosure herein.

Referring to FIG. 7C, the strap button 36 comprises a ring-shaped eyelet, optionally having an angular cutout, i.e., a section of the ring removed in a diagonal cross-section. A strap 72 may be attached to the strap holder 36 by passing a pin 74 through the strap hole of the eyelet. An optional retaining device 76, e.g., a washer, nut or other suitable device can be utilized to secure the pin 74 from slipping from the strap and strap holder. If the ring-shaped eyelet includes an angular cutout, a "quick connect/quick disconnect" may be implemented. For instance, with further reference to FIG. 7E, a view illustrates the "bottom" of the ring-shaped eyelet. In this manner, the user aligns the pin through the strap with the angular cutout and slips the pin into the aperture of the eyelet. If the angular cutout is oriented suitably, e.g., in a generally downward direction when the performer stands holding the instrument, the weight of the instrument will keep the pin/strap from falling out of the eyelet. The eyelet may be replaced by a conventional strap button 36, which extends from the extension rod 34 orthogonal to the length of the rod, thus making the pin 74 and retaining device 76 unnecessary.

Figure 7D:
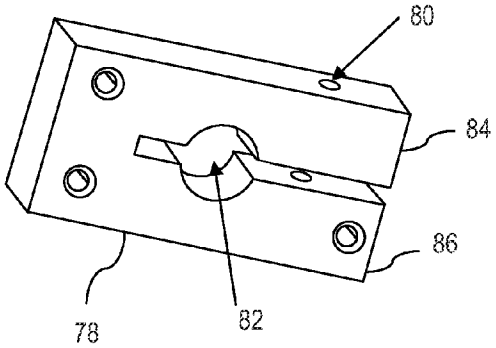
FIG. 7D is a view of a clamp for temporarily securing the extension rod in a designated position, according to aspects of the present disclosure herein.
Figure 7E:
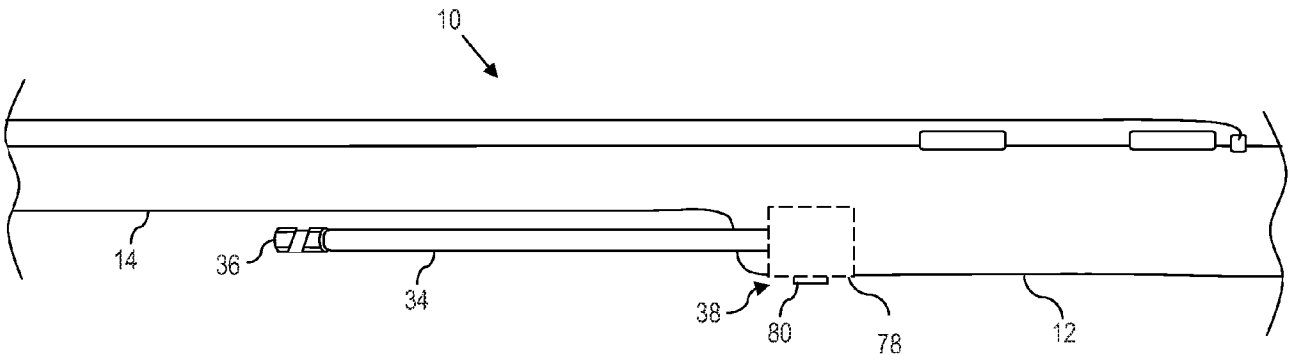
FIG. 7E is a side view showing the extension rod of FIG. 7A in an extended position, according to aspects of the present disclosure herein.

Referring to FIGS. 7A and 7D, the release mechanism 38 may be implemented by a clamp 78 having a screw adjustment 80. The clamp 78 may be integrated into the body 12 of the instrument 10 as best illustrated in FIG. 7E. Alternatively, the clamp 78 may be positioned over/onto the back of the instrument body 12 (not shown). The clamp 78 includes an aperture 82 that receives the shaft of the extension rod 34. The clamp 78 also includes a pair of legs 84, 86. By tightening the screw adjustment 80, the legs 84, 86 are brought together thus clamping down on the extension rod 34. Likewise, releasing the screw adjustment allows the aperture 82 to open slightly, thus allowing the extension rod 34 to slide in and out of the clamp 78.

Referring to FIGS. 7A-7E generally, the illustrated extension strap system may incorporate any combination of features from any of other embodiments described herein. For instance, in this embodiment, the extension rod housing is integrated into the body 12 of the musical instrument 10. However, as noted above, the housing can be attached (e.g., as a retrofit) to an existing instrument 10.

Figure 8:
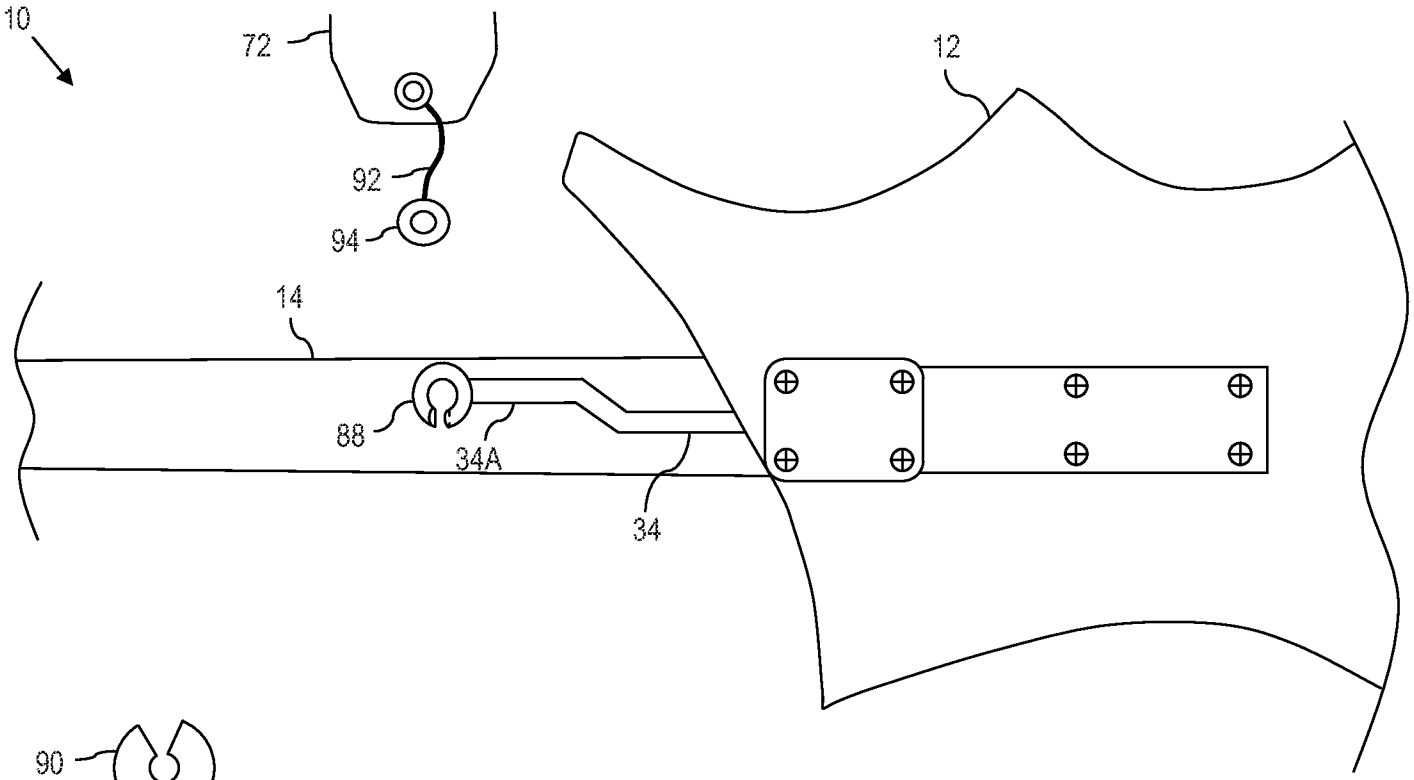
FIG. 8 is a view of a portion of a musical instrument from the back, illustrating an extension rod according to still further aspects of the present invention.

Referring to FIG. 8, in still yet a further alternative implementation, the extension rod 34 defines a half clevis and the strap button is defined by a pin that couples to the half clevis. More particularly, the extension rod 34 includes a half clevis 34A towards the far end thereof. A strap button is implemented as a ring-shaped eyelet 88 (e.g., in a manner analogous to that described with reference to FIGS. 7A-7E) that is secured laterally through an aperture in the extension rod 34, and is secured using a suitable retaining washer 90 (see also, FIG. 9). The strap button may also be a conventional strap button, etc. A strap 72 is secured to the ring-shaped eyelet 88 using any suitable means. For instance, as illustrated, the strap 72 includes a string 92 that is tied through a hole in a pin 94. The pin may pass through the aperture in the clevis at an angle to resist the pin falling out as described above.

Also, the half-clevis provides a bend in the extension rod 34 that allows the user to adjust the positioning of the strap button by adjusting the extension and rotation of the extension rod 34 relative to the body 12. In this regard, the strap button, e.g., ring shaped eyelet 88 (or other suitable structure) may be rotatable about the end of the extension rod 34 to facilitate strap positioning. Otherwise, this strap holder may incorporate any combination of features from any of other embodiments described herein.

Figure 9:
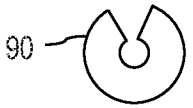
FIG. 9 is an illustration of a lock washer usable with the extension rod of FIG. 8.

Referring to FIG. 9, the locking washer 90 may be utilized to frictionally grab the shaft of the pin 94 so as to hold the pin 94 in position relative to the half clevis. In this regard, the locking washer 90 can include teeth, fins or other features that enable frictional engagement with the pin 94.

Figure 10A:
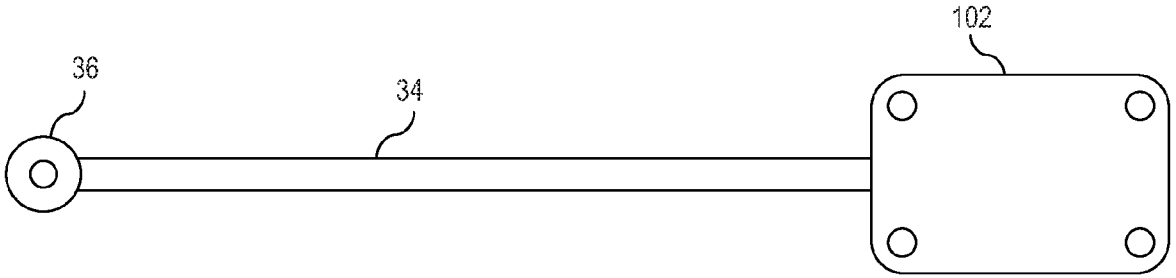
FIG. 10A is a perspective illustration of a short plate adjustable strap holder according to further aspects of the disclosure, where the assembly can be fitted onto existing instruments.
Figure 10B:
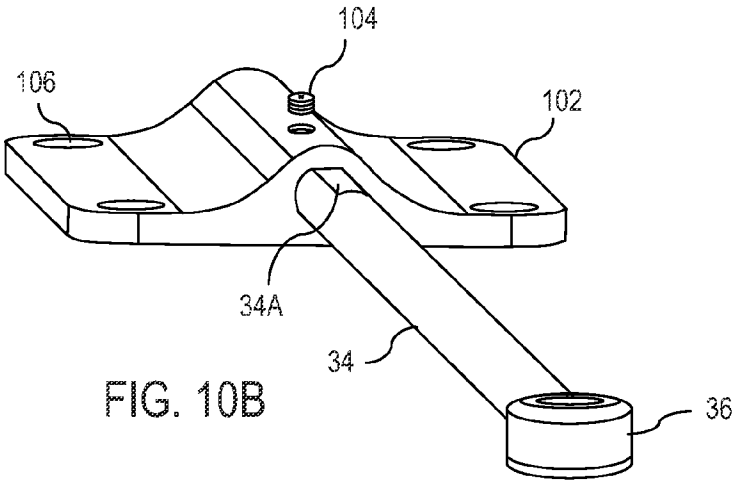
FIG. 10B is a view looking at the back of the short plate adjustable strap holder according to further aspects of the present invention.

Referring to FIGS. 10A and 10B, a short plate adjustable shoulder strap assembly is illustrated according to further aspects of the disclosure. FIG. 10A shows a perspective view and FIG. 10B shows a view looking at the back of the device.

The short plate adjustable shoulder strap assembly includes a housing 102 having an end face and a channel that extends from the end face axially into the housing in a manner analogous to that described herein. An extension rod 34 extends out of the channel of the housing 102 so as to have an exposed end that extends from the end face. A strap button 36 is secured to the exposed end of the extension rod 34 in a manner analogous to that described more fully herein. A release mechanism 104 allows a user to adjust and set a desired length of the extension rod 34 that extends from the housing 102. For instance, as illustrated, the release mechanism comprises a set screw that is threaded through the housing so as to frictionally engage a portion 34A of a shaft of the extension rod 34. More precisely, as illustrated, the extension rod 34 is a generally cylindrical rod having a flattened surface 34A along the length of its shaft that receives a surface of the set screw 104 to temporarily hold the extension rod in frictional engagement with the housing 102.

The short plate adjustable strap assembly is suitable for use as a retrofit or aftermarket accessory that attaches to an existing instrument at the area of the union of the neck and instrument body. For example, the housing 102 may have a set of holes 104 that line up with a conventional neck plate that is typically found on musical instruments with bolt-on style necks. As such, the device can be mounted to a musical instrument without requiring additional holes to be added to the musical instrument body. In this manner, the user can extend the functionality of a musical instrument by improving the balance of the instrument when used with a shoulder strap.

Thus, in an illustrative example, the short plate adjustable strap assembly can be used as a kit that is particularly well suited for bolt-on neck instruments. For instance, the short plate adjustable strap assembly can replace the existing neck plate. As such, the holes typically used to bolt the neck to the body are repurposed to also secure the adjustable neck strap rod to the back of the instrument body. Of course, the short plate adjustable strap assembly is not limited to use on bolt-on neck instruments.

Moreover, the short plate adjustable strap assembly can be implemented in a first implementation that provides no axial adjustment. For instance, the extension rod 34 may be installed and removed from the housing 102. Accordingly, when in use, the strap button is at a fixed position relative to the housing 102.

Another implementation provides user adjustment of the strap button position relative to the housing. For instance, as described more fully herein, the extension rod 34 may be slid within the housing 102 to adjust the distance of the strap button. Once the desired position is achieved, the extension rod 34 is locked relative to the housing 102.

In practice, the extension rod 34 my pass entirely through the housing 102 so that the extension rod extends out both ends of the housing. In this implementation, a stop or other abutment may be provided on the end of the extension rod 34 (on the end opposite the strap button) so as to limit the amount that the extension rod 34 may be extended from housing (see for an example, the stop 34A in FIG. 12A).

In still other implementations, there is no stop. This implementation may be useful in embodiments where it is desirable to completely remove the extension rod 34 from the housing when the device is not in use.

Figure 11A:
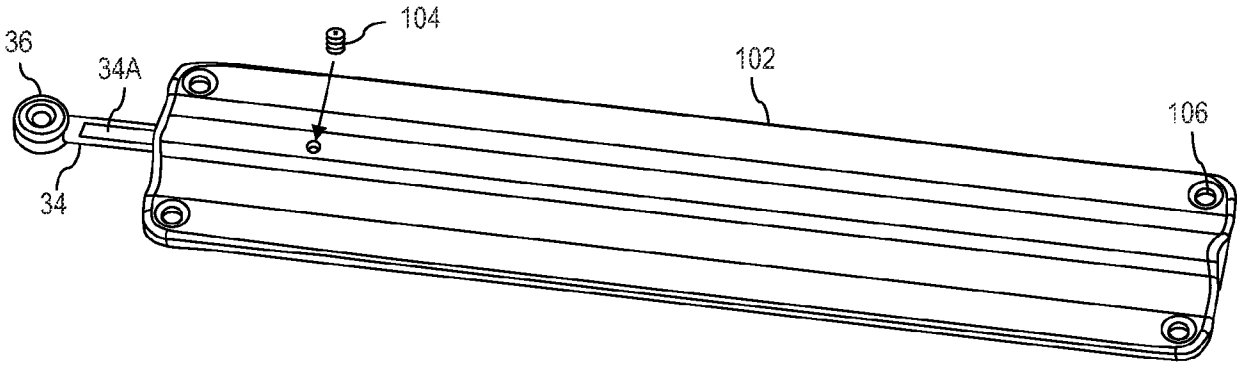
FIG. 11A is a perspective illustration of a long plate adjustable strap holder according to further aspects of the disclosure, where the assembly can be fitted onto existing instruments.
Figure 11B:
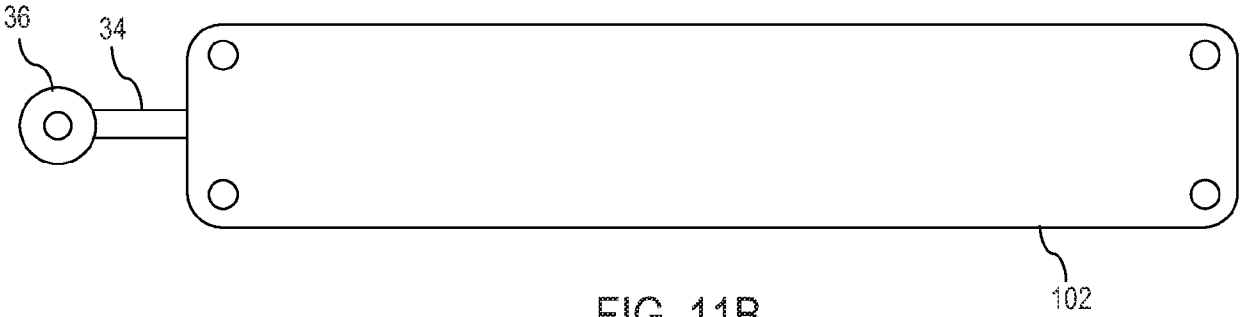
FIG. 11B is a view looking at the back of the short plate adjustable strap holder according to further aspects of the present invention.

Referring to FIGS. 11A and 11B, a long plate adjustable shoulder strap assembly is illustrated according to still further aspects of the disclosure. The long plate adjustable strap assembly is analogous in many respects to the short plate version described with reference to FIGS. 10A and 10B except that the housing 102 is longer.

In a manner analogous to that of FIGS. 10A and 10B, the long plate adjustable shoulder strap assembly includes a housing 102 having an end face and a channel that extends from the end face axially into the housing in a manner analogous to that described herein. An extension rod 34 extends out of the channel of the housing 102 so as to have an exposed end that extends from the end face. A strap button 36 is secured to the exposed end of the extension rod 34 in a manner analogous to that described more fully herein. A release mechanism 104 allows a user to adjust and set a desired length of the extension rod 34 that extends from the housing 102. For instance, as illustrated, the release mechanism comprises a set screw that is threaded through the housing so as to frictionally engage a portion 34A of a shaft of the extension rod 34. More precisely, as illustrated, the extension rod 34 is a generally cylindrical rod having a flattened surface 34A along the length of its shaft that receives a surface of the setscrew 104 to temporarily hold the extension rod in frictional engagement with the housing 102.

For instance, the long plate adjustable shoulder strap assembly is suitable for use as a retrofit or aftermarket accessory that attaches to an existing instrument at the area of the union of the neck and instrument body. For instance, in the case of bolt-on neck instruments, the long plate adjustable strap assembly can also replace the existing neck plate. As such, the holes typically used to bolt the neck to the body are repurposed to also secure the adjustable neck strap rod to the back of the instrument body. By way of illustration, an exemplary implementation of the long plate adjustable shoulder strap assembly is about 7-9 inches long, which is of suitable length to allow the rod to slide fully inside the housing when the rod is retracted.

Figure 12A:
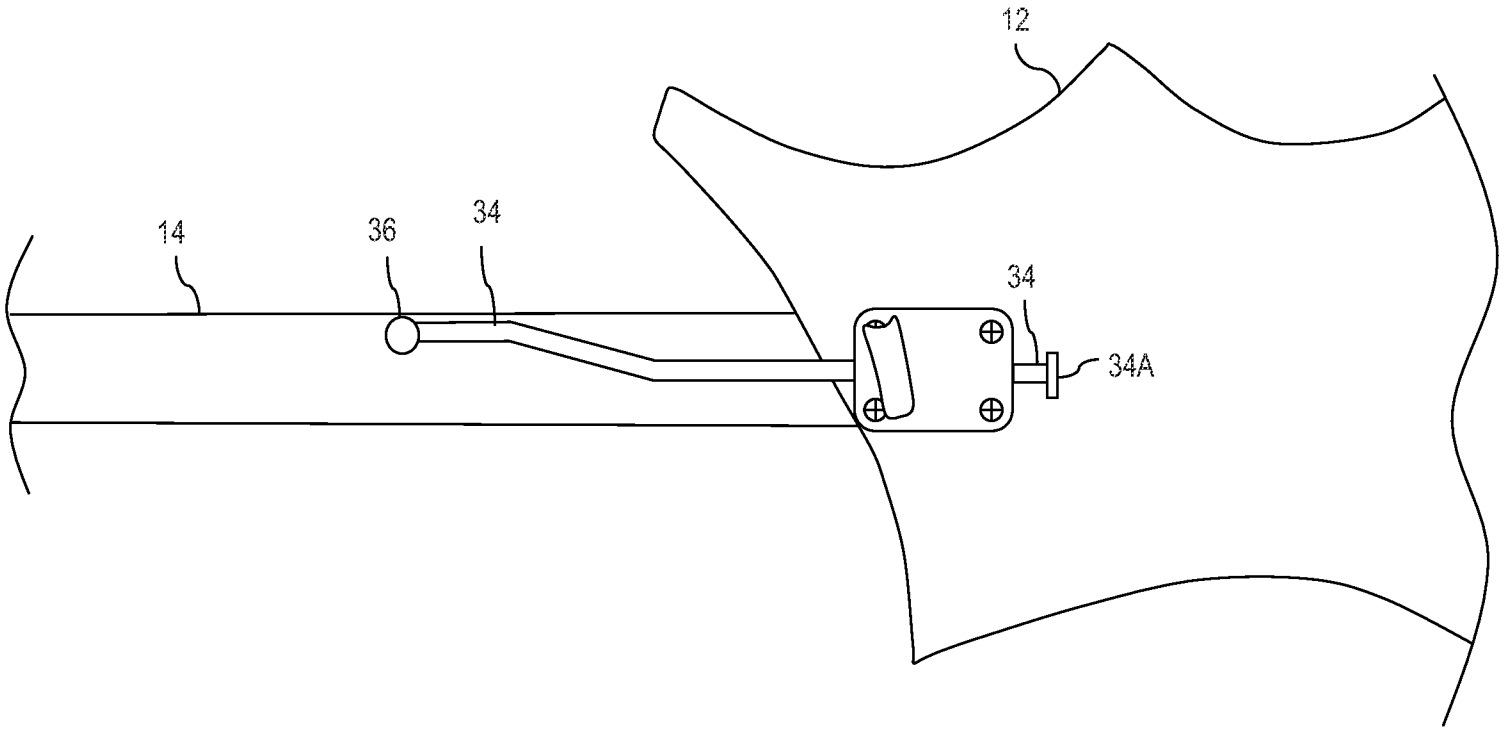
FIG. 12A illustrates an exemplary adjustable strap holder having an extension rod that includes at least two bends, including an upward bend and an inward or outward bend relative to a length of a corresponding instrument.
Figure 12B:
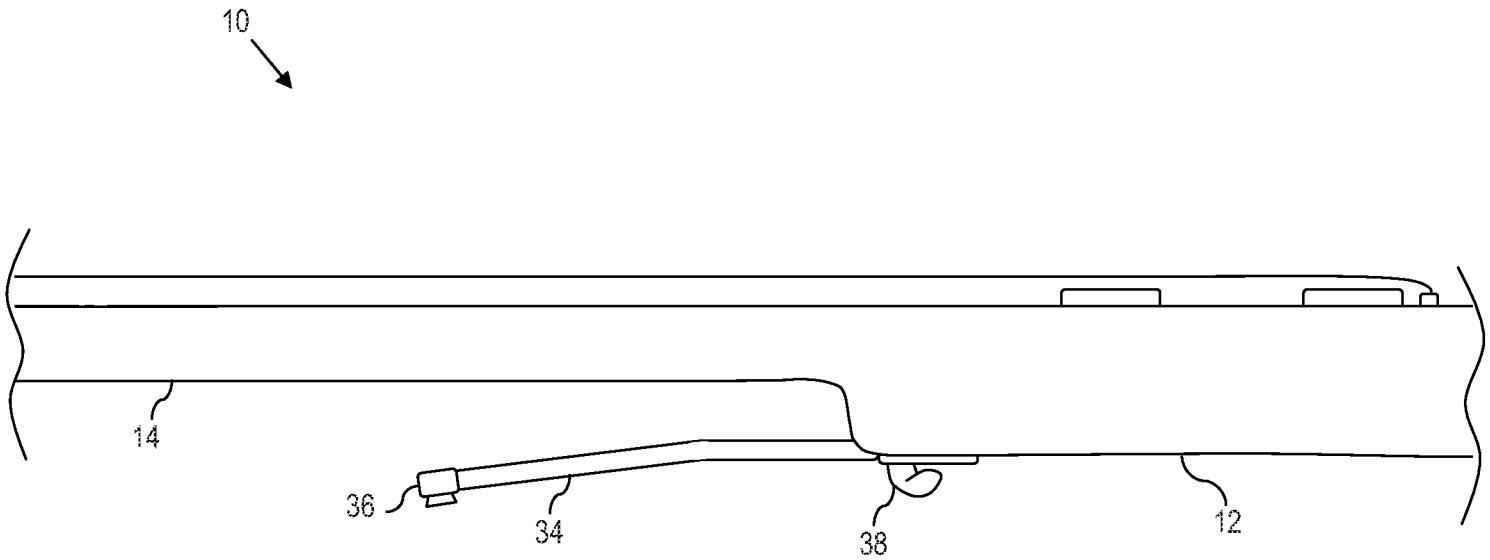
FIG. 12B illustrates the exemplary adjustable strap holder of FIG. 12A from a top view illustrating the outward bend of the extension rod.

Referring to FIGS. 12A and 12B. In yet another illustrative example, the extension rod 34 can be bent in one or more angles to provide any desired performance. For instance, as illustrated, the extension rod 34 bends both "up" and "out". FIG. 12A illustrates the upward bend and FIG. 12B illustrates the outward bend. This configuration may be useful for instance, where the housing is relatively close to the back of the neck 14. The bends allow a performer to freely slide a hand between the neck 14 and the extension rod 34. In practice, the bend (or bends) can take other configurations. For instance, there can be a bend up and a bend in.

FIG. 12A also illustrates an exemplary stop 34A at an end of the extension rod 34.

Miscellaneous:

In the present disclosure, several embodiments and variations are provided. The features set out in each embodiment are not intended to be mutually exclusive. Rather, the features form any embodiment can be combined in any way with one or more other embodiments to provide a desired structure.

Moreover, in certain embodiments, the length of the extension rod may provide a limit to the range of adjustable positions realizable by the strap holder. Also, the length of the housing may limit the range of adjustment of the extension rod. Still further, multiple extension rods, e.g., extension rods of varying length, may be provided so that a user can install a select one of the extension rods to achieve the desired strap button position. Also, as noted more fully herein, the extension rod 34 can extend through the housing.

Various aspects of the present disclosure provide techniques to position a strap button to a designated location along the length of the neck of an instrument, between the body and the headstock of the neck. As such, proper balance can be achieve when wearing a strap, e.g., to play the instrument in a standing position, regardless of the size, weight or combination thereof, of the body and neck.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention.

Having thus described the invention of the present application in detail and by reference to embodiments thereof, it will be apparent that modifications and variations are possible without departing from the scope of the invention defined in the appended claims.

What is claimed is:

1. An adjustable strap holder for a stringed musical instrument, comprising:

a housing having an end face and a channel that extends from the end face axially into the housing;

an extension rod that extends out of the channel of the housing so as to have an exposed end that extends from the end face; and a release mechanism operable by a user so as to allow the extension rod to be adjusted axially relative to the housing;

wherein:

the housing is constructed from a body of the stringed musical instrument, where the stringed instrument comprises a neck that extends from the body; and the channel extends into the body parallel to and behind the neck, wherein the end face is located at the neck joint where the neck joins the body.

2. The adjustable strap holder of claim 1, wherein the extension rod is spaced behind, and away from the back of the neck of the stringed musical instrument, and is axially adjustable in the direction along a length of the neck.

3. The adjustable strap holder of claim 1, wherein the channel comprises a select one of: a passage routed through the back of the body, or a hole drilled through the body.

4. The adjustable strap holder of claim 1, wherein the release mechanism comprises a clamp having a user operable feature on the outside of the housing, where the clamp is user adjustable between a first position where the extension rod is capable of sliding within the channel, and a second position where the extension rod is locked from axial movement relative to the channel.

5. The adjustable strap holder of claim 1, wherein the release mechanism comprises a friction mechanism that resists axial movement of the extension rod, where the resistance is overcome by a user pushing the extension rod inward to shorten the amount that the extension rod extends from the end face, and by pulling the extension rod to increase the amount that the extension rod extends from the end face.

6. The adjustable strap holder of claim 1 further comprising:

a strap button secured to an end of the extension rod.

7. The adjustable strap holder of claim 6, wherein the extension rod comprises a bend therein that allows the user to adjust the positioning of the strap button by adjusting the extension and rotation of the extension rod relative to the body, and the strap button is defined by a ring-shaped eyelet having an angular cutout arranged such that a section of the ring is removed in a diagonal cross-section.

8. The adjustable strap holder of claim 1, wherein the extension rod includes at least one bend therein.

9. The adjustable strap holder of claim 1, wherein the release mechanism is operable by a user to provide adjustability for installing and removing the extension rod from the housing.

10. The adjustable strap holder of claim 1, wherein the release mechanism is operable by a user to provide adjustability for extending and retracting the extension rod within the housing.

11. A musical instrument having a body and neck that extends from the body, the stringed musical instrument comprising:

a channel that extends from an end face of the body proximate to an intersection of the neck and body, where the channel extends axially into the body; and an extension rod that extends into the channel so as to have an exposed end that extends from the end face; and a strap button secured to the exposed end of the extension rod.

12. The musical instrument of claim 11, wherein the channel extends into the body parallel to, and behind, the length of the neck.

13. The musical instrument of claim 11, wherein the extension rod is adjusted so as to extend axially parallel to, and spaced from the back of the neck.

14. The musical instrument of claim 11 further comprising:

a release mechanism that is operated by a user so as to allow the extension rod to be adjusted axially relative to the end face.

15. An adjustable strap holder for a stringed musical instrument, comprising:

a housing having an end face and a channel that extends from the end face axially into the housing;

an extension rod that extends out of the channel of the housing so as to have an exposed end that extends from the end face; and a release mechanism operable by a user so as to allow the extension rod to be adjusted axially relative to the housing;

wherein the housing is defined by a plate that is secured to the back of an instrument body, the plate having a channel for receiving the extension rod.

16. The adjustable strap holder of claim 15, wherein the plate forms the housing and channel in combination with the back of the instrument body.

17. The adjustable strap holder of claim 15, wherein:

the release mechanism comprises a set screw that is threaded through the housing so as to frictionally engage a portion of a shaft of the extension rod; and the extension rod is a generally cylindrical rod having a flattened surface along the length of its shaft that receives a surface of the set screw to temporarily hold the extension rod in frictional engagement with the housing, such that the release mechanism allows a user to adjust and set a desired length of the extension rod that extends from the end face.

18. The adjustable strap holder of claim 15, wherein the release mechanism comprises a clamp having a user operable feature on the outside of the housing, where the clamp is user adjustable between a first position where the extension rod is capable of sliding within the channel, and a second position where the extension rod is locked from axial movement relative to the channel.

19. The adjustable strap holder of claim 15, wherein the release mechanism comprises a friction mechanism that resists axial movement of the extension rod, where the resistance is overcome by a user pushing the extension rod inward to shorten the amount that the extension rod extends from the end face, and by pulling the extension rod to increase the amount that the extension rod extends from the end face.

20. The adjustable strap holder of claim 1, wherein the extension rod includes at least one bend therein.

* * * * *